United States Patent [19]

Waldrop et al.

[11] 4,325,791

[45] Apr. 20, 1982

[54] METHOD FOR PROVIDING URANIUM ARTICLES WITH A CORROSION RESISTANT ANODIZED COATING

[75] Inventors: Forrest B. Waldrop, Powell; Charles A. Washington, Oak Ridge, both of Tenn.

[73] Assignee: The United States of America as represented by the United States Department of Energy, Washington, D.C.

[21] Appl. No.: 222,865

[22] Filed: Jan. 7, 1981

[51] Int. Cl.[3] ..... C25D 11/34

[52] U.S. Cl. ..... 204/32 R; 204/56 R

[58] Field of Search ..... 204/32 R, 56 R

[56] References Cited

U.S. PATENT DOCUMENTS 2,884,364 4/1959 Rebol et al. ..... 204/32 R 2,965,551 12/1960 Richaud ..... 204/32 R

OTHER PUBLICATIONS

"The Anodic Oxidation of U", by O. Flint et al., ACTA Metallurgica, vol. 2, Sep. 1954, pp. 696–712.

*Primary Examiner*—R. L. Andrews

*Attorney, Agent, or Firm*—Earl L. Larcher; Stephen D. Hamel; Richard G. Besha

[57] ABSTRACT

Uranium articles are provided with anodized oxide coatings in an aqueous solution of an electrolyte selected from the group consisting of potassium phosphate, potassium hydroxide, ammonium hydroxide, and a mixture of potassium tetraborate and boric acid. The uranium articles are anodized at a temperature greater than about 75° C. with a current flow of less than about 0.036 A/cm$^2$ of surface area while the pH of the solution is maintained in a range of about 2 to 11.5. The pH values of the aqueous solution and the low current density utilized during the electrolysis prevent excessive dissolution of the uranium and porosity in the film or watering. The relatively high temperature of the electrolyte bath inhibits hydration and the attendant deleterious pitting so as to enhance corrosion resistance of the anodized coating.

6 Claims, No Drawings

METHOD FOR PROVIDING URANIUM ARTICLES WITH A CORROSION RESISTANT ANODIZED COATING

BACKGROUND OF THE INVENTION

The present invention is directed generally to a method for protecting uranium articles from corrosion and more particularly to the anodizing of uranium articles in aqueous electrolytes to provide the uranium articles with a corrosion-resistant oxide coating. This invention was made as the result of a contract with the U.S. Department of Energy.

One of the significant drawbacks and problems attendant with the use of uranium in the nuclear industry is due to the susceptibility of uranium to corrosion. The most common form of corrosion is that which occurs in air due to the presence of oxygen and water vapor. Efforts to protect uranium metal from corrosion in air and in other environments in which the uranium is to be used have met with some success. For example, uranium metal is often protected from corrosion by applying an adherent coating of metal resistant to the particular corrosive environment in which the uranium article is to be exposed.

Another technique found to be capable of providing some protection to uranium from corrosion is by forming an adherent oxide film or coating on the uranium surface by anodizing. While the corrosion and abrasion resistance provided by the anodized oxide layer showed substantial improvement over the naturally formed oxide layers, the anodized layer applied by previously known techniques has not been sufficiently adherent or integral with the uranium article to provide the desired level of corrosion protection. For example, previous efforts utilized to provide anodic oxidation of uranium metal involved the use of both aqueous and non-aqueous electrolytes. As described in the publication, "The Anodic Oxidation of Uranium," *ACTA Metallurgia,* Vol. 2, No. 5, 696 (1954) by Flint et al, the anodizing of uranium metal in an aqueous electrolyte of ammonium borate was not particularly successful due to the formation of excessive pitting caused by the aqueous electrolyte. To overcome this pitting problem, it was suggested in this publication that the anodizing should be achieved in a non-aqueous electrolyte to provide a level of corrosion protection. In a non-aqueous electrolyte of ammoniacal ethylene glycol at a constant temperature of 0° C. and a voltage of 275 volts the uranium article was provided with an anodized surface. However, considerable effort was required to maintain the anhydrous bath in that a tube of phosphorous pentoxide was required to be suspended in the bath to prevent absorption of water vapor from the air which would induce the deleterious pitting in the anodized coating. With this non-aqueous bath a relatively marginal level of corrosion-resistance was provided for the uranium article by the anodized coating.

SUMMARY OF THE INVENTION

It is the primary aim or objective of the present invention to provide corrosion protection to uranium articles by forming a protective oxide layer on the uranium surface. Electrolytic deposition in an aqueous electrolyte forms an adherent corrosion-resistant layer of uranium oxide on the uranium metal. This oxide layer provides the uranium substrate with a level of corrosion protection corresponding to that provided with adherent nickel coatings. The method for providing a uranium article with the corrosion-resistant anodized coating comprises the steps of providing an aqueous electrolyte selected from the group consisting of aqueous solutions of potassium phosphate, potassium hydroxide, ammonium hydroxide and a mixture of potassium borate and boric acid. The solution is maintained at a pH value in the range of about 2 to 11.5 and at a temperature of at least 75° C. during the formation of the anodic oxide coating. The uranium article to be treated is immersed into the electrolyte with appropriate electrode couplings and then a voltage is introduced into the electrolyte sufficient to maintain a current density of less than about 0.036 amperes/cm$^2$ between the electrodes for a duration sufficient to provide an equilibrium in the thickness of the coating.

The quality of the anodized coating provided by the electrolysis of the uranium article in the aforementioned aqueous solutions was somewhat unexpected in that the pitting problems heretofore encountered in attempts to anodize in aqueous solutions did not occur. While the mechanism by which the present invention overcomes this pitting problem is not clearly understood, it is believed that the relatively high temperature utilized for the anodizing prevents hydration and attendant pitting problems. The anodized coating is highly resistant to corrosion of the underlying uranium articles in environments containing moisture. Also, by employing the subject anodizing procedure a minimal quantity of uranium is removed from the surface of the article.

Other and further objects of the invention will be obvious upon an understanding of the illustrative method about to be described or will be indicated in the appended claims, and various advantages not referred to herein will occur to one skilled in the art upon employment of the invention in practice.

DETAILED DESCRIPTION OF THE INVENTION

As briefly mentioned above, the method of the present invention is directed to the corrosion protection of uranium articles by forming a corrosion-resistant oxide coating on the surface of uranium articles through electrolysis with an aqueous electrolyte. The corrosion-resistant coatings formed by the electrolysis are of an essentially uniform thickness in a range of about $1\times10^{-7}$ to $1\times10^{-4}$ inch.

In practicing the method of the present invention, uranium articles are cleansed of surface impurities prior to applying the coating with uranium oxide in the aqueous electrolyte described below. Immediately after cleaning the uranium articles they are coupled to appropriate electrodes and immersed into the electrolyte bath. Satisfactory results have been achieved by connecting the positive lead of the power supply to the uranium article and the negative lead to a cathode formed of a suitable metal, such as stainless steel. A voltage in the range of about 10 to 150 volts is then applied to the electrolytic cell to establish current flow through the uranium article. The voltage is then adjusted to maintain the current flow below about 0.036 A/cm$^2$. The solution is preferably agitated during this electrolysis, the pH of the electrolyte is adjusted or maintained within about the range of 2–11.5, and appropriate heaters are utilized to maintain the bath at a temperature of at least 75° C.

The electrolysis is continued for a duration sufficient to attain an oxide layer of the desired uniform thickness. The uranium article is then removed from the bath and the residual electrolyte rinsed therefrom in a bath of distilled water.

The preparation of the uranium article for the anodizing operation may be achieved in any suitable manner. For example, the surfaces of the uranium article may be first cleansed with an abrasive, such as pumice, and then degreased in a suitable solvent, such as perchloroethylene. The oxides may then be removed from the uranium article by immersing it in a warm pickling solution containing about 30 to 40 vol.% of nitric acid. The pickling solution may be washed from the uranium surface in distilled water. Preferably, the uranium article is electropolished in an aqueous solution containing 75 to 80 vol.% of sulfuric acid and about 15 grams per liter of chromate ($CrO_3$) for a period of about 1 to 3 minutes at a temperature of 25° C. with a current up to about 0.007 $A/cm^2$ of surface area to make the surface more uniform. The uranium article may then be dipped again in the aforementioned nitric acid pickling solution and rinsed with water until confirmation of a water break test which indicates that the surface is clean.

The aqueous electrolyte is a solution of potassium hydroxide, potassium phosphate, ammonium hydroxide, or a mixture of potassium tetraborate and boric acid. The concentrations of the potassium hydroxide in the electrolyte is about 0.18 to about 1.0 molar. The potassium phosphate is in the concentration of a range of about 0.045 to 0.27 molar. The ammonium hydroxide is in a concentration of about 0.75 to 2.25 molar. The mixture of potassium tetraborate and boric acid is in a concentration of about 0.01 to 0.10 molar and 0.2 to 0.4 molar, respectively.

The pH of the bath is maintained within the range of about 2 to 11.5 for eliminating the pitting. Preferably, the pH of the electrolyte in the bath is adjusted to be in a range between about 6 and 8. A suitable pH adjusting substance is nitrilo trimethyl phosphonic acid. It has been found that this substance is a chelating agent and appears to provide a stabilizing mechanism for the anodizing operation so that the resulting oxide film is actually more uniform and dense than films provided without the addition of a chelating agent. This additional uniformity of density is believed to provide greater corrosion resistance and applicability of the process to the overall corrosion inhibition of uranium articles.

The temperature of the bath is maintained at a temperature greater than about 75° and in a range of about 75° to 95° C. to provide satisfactory electrolysis and anodizing of the uranium articles. As briefly pointed out above, it is believed that the temperature of the electrolyte is of primary importance in the formation of a uniformly dense layer of corrosion-resistant oxide obviating the occurrence of deleterious hydration and pitting. This heating of the electrolyte may be achieved in any suitable manner, such as a hot plate with a magnetic stirrer.

With the pH of the solution adjusted to the appropriate value, preferably with the use of the aforementioned chelating agent, an electrical potential of about 10 to 150 volts is applied to the uranium article when immersed in the electrolyte. The voltage is selected and slowly raised so that the current density does not exceed 0.036 $A/cm^2$. Greater than about 0.036 $A/cm^2$ results in excessive removal of the uranium material from the article as well as induces deleterious pitting porosity in the film. The growth rate of the oxide film is also controlled by the current density.

In the electrolysis operation the oxide is continuously formed and chemically dissolved by the action of the electrolyte. The anodized oxide film is formed at a rate faster than it is dissolved during the initial stages of the operation. However, as the oxide film grows thicker a larger surface area of the oxide film is exposed to the solvent action of the electrolytes which results in some chemical dissolution of the oxide film at a slower rate than it is formed. An oxide film thickness is eventually reached during this electrolysis in which the oxide is dissolved at a rate much slower than that being formed so as to attain an equilibrium in film thickness as indicated by the lack of current flow through the circuit.

The period for electrolysis is normally for a period of about 20–30 minutes duration to effect a formation of an oxide layer in the aforementioned thickness range.

After it has been determined that the oxide film of the desired thickness is formed, the electrolysis operation is terminated and the uranium article is removed from the bath and rinsed in distilled water to remove residual electrolyte from the surface of the article.

In order to provide a more facile understanding of the present invention examples are set forth below describing the anodizing method of the present invention in which each of a plurality of uranium articles is provided with an anodized oxide coating.

EXAMPLE I

Fifty-seven coupons of uranium were cleansed of surface impurities and electropolished as described above. These fifty-seven coupons were then divided so that twenty-one coupons were anodized in an electrolyte of 0.27 M potassium phosphate, sixteen in an electrolyte of 1-OM potassium hydroxide, and the remainder in 2.25 M ammonium hydroxide. In each bath the coupons were numerically divided so that voltage levels of 10, 20, 30, 60, and 130 volts could be utilized in each bath at selected pH values of 12, 9, and 7 for the baths of potassium hydroxide and ammonium hydroxide. The pH values in the potassium phosphate both were at 9, 7, 4 and 2.5. Upon completion of the anodizing operation it was found that the thickness of the oxide coating was proportional to voltage utilized in the anodizing operation. The different pH values resulted in slight changes in color and thicknesses. The coatings on each of the uranium articles were of sufficient uniformity and density to provide corrosion resistance in a moisture-containing atmosphere equivalent to that obtained with adherent nickel coatings.

EXAMPLE II

An electrolyte bath containing 10 grams per liter of potassium tetraborate and 20 grams per liter of boric acid was utilized to anodize 20 uranium articles. Each of the uranium articles had a surface area of 4.3 square inches and was successfully anodized in the bath which was heated to a temperature of 85° C. The pH of the bath was adjusted with nitrilo trimethyl phosphonic acid to 7. The coupons were divided and anodized at voltages of 10, 20, 30, 60, and 120 volts for 20 minutes. The coatings on the coupons were found to be similar to the coatings obtained with the electrolytes described in Example I and possessed a similar level of corrosion resistance.

Uranium articles provided with the above-described anodized coatings provide a significant degree of corrosion resistance. For example, uranium articles provided with an oxide film in accordance with the present invention were exposed to a normal laboratory atmosphere for 10 months and were found to be essentially free of corrosion. On the other hand, unprotected uranium articles exposed to this atmosphere would show considerable corrosion in a period of about 2 weeks. The uranium coupons or articles provided with these anodized coatings were comparable in corrosion resistance to electrodeposited nickel coatings in moisture-containing atmospheres including environments having a relative humidity of about 100%.

What is claimed is:

1. A method for providing a uranium article with a corrosion-resistant anodized oxide coating comprising the steps of providing an aqueous solution of electrolytes selected from the group consisting of potassium phosphate, potassium hydroxide, ammonium hydroxide, and a mixture of potassium tetraborate and boric acid, maintaining the solution at a pH value in the range of about 2 to 11.5 and at a temperature of at least 75° C., immersing the uranium article into the electrolyte and maintaining a current density of less than about 0.036 $A/cm^2$ between electrodes for a duration sufficient to provide an equilibrium in the thickness of the oxide coating.

2. The method claimed in claim 1, including the additional steps of cleansing the uranium article of surface contaminants including oxide prior to immersing the uranium article into the aqueous electrolyte, and rinsing residual electrolyte from the oxide-coated uranium article upon completion of the electrolysis step.

3. The method claimed in claim 1 wherein an adequate quantity of nitrilo trimethyl phosphonic acid is added to the electrolyte to sufficiently stabilize the electrolyte for providing a coating of greater uniformity and density than obtainable without the addition of the nitrilo trimethyl phosphonic acid.

4. The method claimed in claim 1, wherein the concentration of potassium hydroxide in the aqueous electrolyte solution is in the range of about 0.18 to 1.0 molar, the concentration of potassium phosphate in the aqueous electrolyte solution is in the range of about 0.045 to 0.27 molar, the concentration of ammonium hydroxide in the aqueous electrolyte solution is in the range of about 0.75 to 2.25 molar, and wherein the concentration of potassium tetraborate and boric acid in the aqueous electrolyte solution is in the range of about 0.01 to 0.1 molar and about 0.2 to 0.4, respectively.

5. The method claimed in claim 1, wherein the temperature of the electrolyte during the formation of the anodized oxide coating is maintained in the range of 75° to 95° C.

6. A uranium article comprising a uranium metal substrate with an essentially uniform and adherent anodized oxide coating thereon of a thickness in the range of about $1\times10^{-7}$ to $1\times10^{-4}$ inch as prepared by the method of claim 1.

* * * * *